US007631464B2

(12) United States Patent
Valentz et al.

(10) Patent No.: US 7,631,464 B2
(45) Date of Patent: Dec. 15, 2009

(54) POLYMERIC INSULATED GLAZING UNIT WITH MOLDED FRAME

(75) Inventors: Arthur J. Valentz, Sugar Land, TX (US); John E. Nemazi, Bloomfield Hills, MI (US)

(73) Assignee: VTech Patents LLC, Houston, TX (US)

( * ) Notice: Subject to any disclaimer, the term of this patent is extended or adjusted under 35 U.S.C. 154(b) by 151 days.

(21) Appl. No.: 11/671,657

(22) Filed: Feb. 6, 2007

(65) Prior Publication Data

US 2007/0180789 A1 Aug. 9, 2007

Related U.S. Application Data

(63) Continuation-in-part of application No. 11/057,891, filed on Feb. 12, 2005.

(51) Int. Cl.
*E04B 7/18* (2006.01)

(52) U.S. Cl. ..... 52/200; 52/22; 52/72

(58) Field of Classification Search ..... 52/200, 52/22, 97, 72

See application file for complete search history.

(56) References Cited

U.S. PATENT DOCUMENTS 3,434,251 A 3/1969 Kiekhaefer
4,073,097 A * 2/1978 Jentoft et al. ..... 52/22
4,296,578 A * 10/1981 Keckman ..... 52/200
4,333,295 A 6/1982 Janke
4,344,261 A 8/1982 Weisner et al.
4,408,422 A 10/1983 Bechtold
4,441,284 A 4/1984 Bechtold
4,514,944 A 5/1985 Doell
4,549,379 A * 10/1985 Hoy et al. ..... 52/200
4,594,821 A * 6/1986 Bechtold et al. ..... 52/72
4,750,302 A 6/1988 Bechtold
4,972,638 A * 11/1990 Minter ..... 52/200
2005/0055901 A1 3/2005 Valentz et al.

* cited by examiner

*Primary Examiner*—Richard E Chilcot, Jr.
*Assistant Examiner*—Chi Q Nguyen
(74) *Attorney, Agent, or Firm*—Brooks Kushman P.C.

(57) ABSTRACT

A skylight is formed with a pair of plastic panels having a similarly sized outer peripheral flange and a central region transparent to visible light, aligned in a stacked orientation with the peripheral flanges overlying one another and defining an enclosed central region in-between. Elongated two-sided elastic tape seal is interposed between and bonded to the outer peripheral flanges of elastic panels to form a sealed enclosed region. A peripheral frame is formed in situ about the plastic panels from a moldable polymeric material which entraps the peripheral flanges forming a unitary type structure with the elastic two-sided tape preventing intrusion of the moldable polymeric frame material into the enclosed region.

24 Claims, 4 Drawing Sheets

POLYMERIC INSULATED GLAZING UNIT WITH MOLDED FRAME

CROSS-REFERENCE TO RELATED APPLICATIONS

This application is a continuation-in-part of co-pending U.S. application Ser. No. 11/057,891 filed Feb. 12, 2005.

BACKGROUND OF THE INVENTION

1. Field of the Invention

The present invention relates to window containing structures having a molded polymeric frame extending about the outer peripheral flange of a pair of transparent plastic panels.

2. Background Art

Window containing structures in buildings such as a skylights, and window assemblies and certain types of doors, are typically formed of a light transparent panel of glass or plastic mounted in a peripheral frame formed of wood, metal or extruded plastic. In order to provide good thermal insulation, two spaced apart transparent layers are frequently utilized creating an enclosed region there between which is filled with gas. Windows and doors typically use a pair of glass transparent panels joined together about their outer peripheral edge by a spacer forming an insulated glass unit (IGU). Skylights can alternatively be formed with glass panels or plastic panels. Since skylights typically do not require the same degree of optical quality as windows, low cost and light weight plastic panels can be utilized in place of glass. In order to achieve structural rigidity, the plastic panels are frequently, outwardly, domed in a convex manner, the peripheral edges of the plastic panels mounted in a rectangular or circular mounted frame. Typically, the periphery of the plastic panels are attached to the frame interposed between a frame curb portion and a mounting flange, and held together by a series of fasteners.

In U.S. patent publication application No. 2005-0178078-A1, which is incorporated by reference in its entirety, a window containing assembly with a molded plastic frame is disclosed. Several embodiments provide a peripheral polymeric frame is molded about an IGU. The IGU seal prevents plastic from intruding into the internal central region of the IGU during molding.

SUMMARY OF THE INVENTION

It is an object of the present invention to the manufacturing of windows having a molded plastic frame and a multi-layer plastic skylight panel. It is therefore important to prevent intrusion of the moldable plastic frame material into the central region of the overlapping plastic panels. It is necessary to have a good seal when the mold is closed between the spacer and the peripheral plastic panels. When plastic panels are sag bent into a dome shape, it is common to have some variations in the peripheral flange flatness, particularly in the corner regions. These variations in flatness between adjacent plastic panels can result in a leak path enabling polymeric material to intrude into the central region of the light transmission layer pair which can adversely affect frame strength as well as providing an unsightly protrusion into the visible area of the window.

It is an object of the present invention to provide a skylight having a good seal between the outer peripheral flanges of the plastic light transparent panels to prevent intrusion of the moldable plastic material of the frame during the molding process into the enclosed region of the plastic panels, while accommodating normally occurring flatness variations between panels resulting from plastic panel thermoforming.

Accordingly a glazing unit is provided having a pair of plastic light transparent panels aligned in stacked relation having cooperating outer peripheral flanges which overlie one another. The outer peripheral flanges are bonded together utilizing an elongate two-sided tape seal to form an enclosed central region between the plastic panels. A peripheral frame is formed in situ of a molded polymeric material about the pair of plastic panels entrapping the peripheral flanges forming a leak tight structure.

The glazing unit of the present invention is particularly well suited for use as a skylight in both small residential and large commercial applications. The two-sided elastic tape can be a close cell foam tape having a width of 0.25 to 1.5 inches and an uncompressed nominal thickness of 0.03 to 0.20 inches. The two-sided elastic tape enjoins and aligns the pair of plastic panels making it easy to handle the plastic panels when inserting them into a mold. The mold is then closed and a moldable polymeric material is introduced into the mold cavity forming a unitary peripheral flange in situ about the peripheral edge of the plastic panels.

In one of the embodiments of the invention illustrated, the pair of plastic light transmitting panels are formed of acrylic. The peripheral flange is molded in situ from a RIM polyurethane material forming a leak tight joint between the peripheral frame and the entrapped peripheral flanges of the transparent plastic panels.

In another embodiment of the invention, a glazing unit is formed from two or more overlying plastic light transparent panels having cooperating outer peripheral flanges which are joined together by an elongate two-sided elastic tape seal interposed there between. A peripheral frame is formed in situ of a thermoplastic material about the pair plastic panels entrapping the peripheral flanges thereof forming a leak tight structural joint. The two-sided elastic tape prevents intrusion of the molding material into the enclosed region between the transparent plastic panels during the molding operation. Preferably, the injected molded thermoplastic polymer is further provided with reinforcing fibers to enhance frame rigidity.

In another embodiment of the invention a method of forming a glazing unit is provided. A pair of plastic panels are formed from sheets of light transparent plastic. The plastic panels have an outer peripheral flange and a central region which, when stacked upon one another, define an enclosed cavity bounded by the spaced apart panel central regions. A two-sided elastic tape strip is installed on one of the peripheral flanges of the pair of plastic panels providing a substantially continuous seal about the entire peripheral region. The plastic panels, when stacked, cause the two-sided tape to form a continuous seal about the overlying peripheral flange portions.

Once joined, the stacked subassembly is inserted into a mold for forming a frame. The mold is then closed and moldable polymeric material is injected into the mold cavity forming a frame in situ which is securely bonded to the peripheral flanges of the plastic panels. The two-sided elastic tape prevents the moldable polymeric material from entering into the central region defined by the spaced apart plastic panel central regions. The assembly is then removed from the mold.

In one embodiment of the invention, the method is practiced by injecting a RIM polymeric material into the mold, in another a thermoplastic material is used.

DETAILED DESCRIPTION OF THE PREFERRED EMBODIMENT(S)

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for the claims and/or as a representative basis for teaching one skilled in the art to utilize the present invention.

Figure 1:
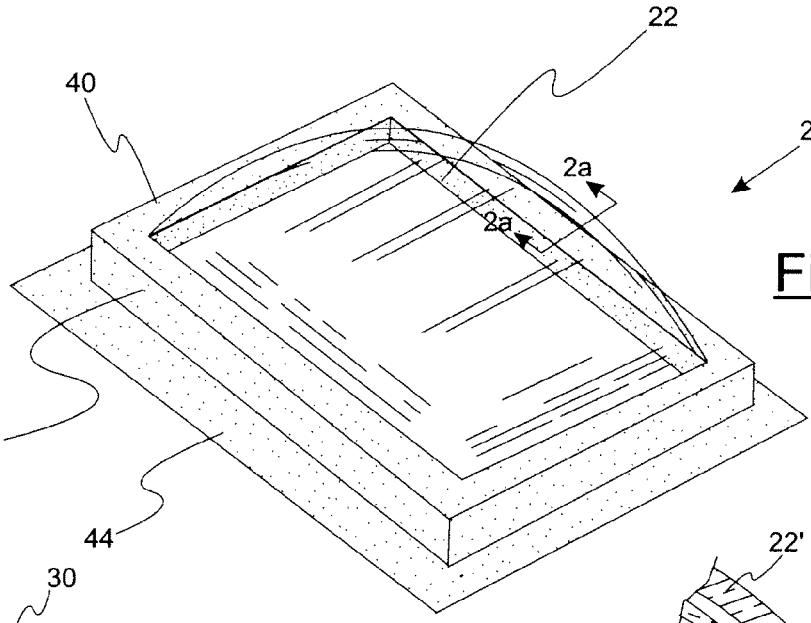
FIG. 1 is a perspective view of a first skylight embodiment of the invention.
Figure 2A:
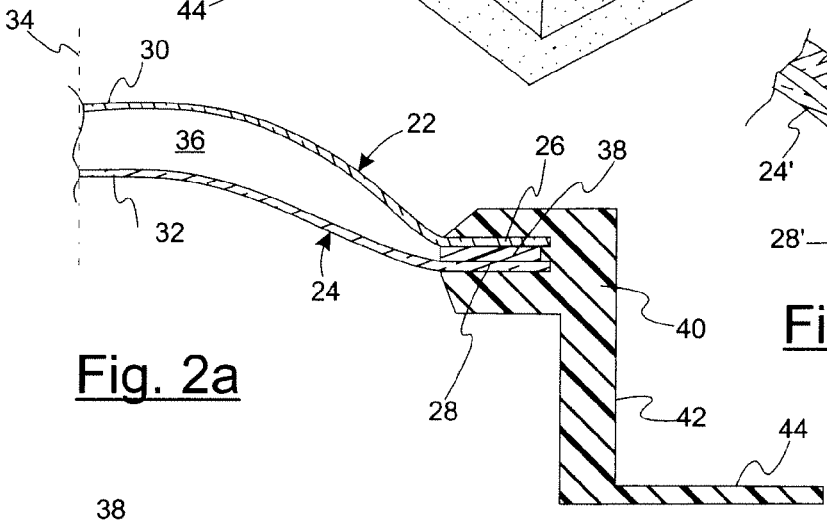
FIG. 2*a* is a cross-section taken along section 2*a*-2*a* of FIG. 1.

A glazing unit, namely, a skylight assembly 20 illustrating an embodiment of the present invention as illustrated in FIGS. 1 and 2*a*. The skylight 20 is provided with a pair of plastic panels 22 and 24 each having a similarly sized outer peripheral flanges 26 and 28 which extend about the periphery of the plastic panels. The plastic panels are provided with a central region 30 and 32 which are at least semi-transparent to visible light. When plastic panels 22 and 24 are stacked together in alignment about a central axis 34, spaced apart central regions 30 and 32 define an enclosed space 36 there between.

Peripheral edges 26 and 28 of plastic panels 22 and 24 are bonded together by an elongate two-sided elastic taped seal 38 which is interposed between the outer peripheral flanges 26 and 28 to form a seal enclosing central region 36. Central region 36 is filled with air or other suitable gas to provide a thermal barrier when the skylight is installed in the roof of a building.

A peripheral frame 40 is formed in situ of a moldable polymeric material extending about the plastic panels and entrapping the peripheral flanges 26 and 28 securely therein and forming a leak tight structural joint between the peripheral frame 40 and the pair of plastic panels 22 and 24. Peripheral frame 40 in the skylight embodiment illustrated is provided with an integrally formed curb portion 42 and a flashing portion 44 sufficiently sized to stand the peripheral frame 40 above the roof surface to which the skylight is mounted. Flashing 44 facilitates the mechanical connection of the skylight assembly to the building roof and provides a water tight seal between the skylight assembly 20 and the building roofing system.

Figure 2B:
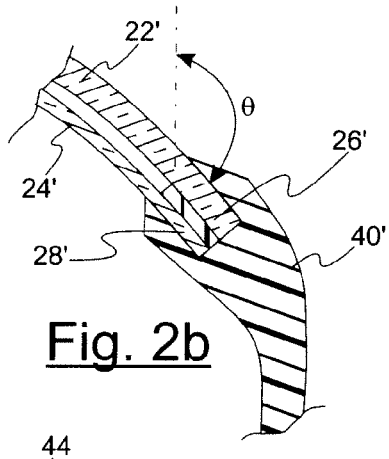
FIG. 2*b* is a cross-section of an alternative embodiment.

FIG. 2*b* illustrates an alternative construction in which frame 40' is downwardly outwardly sloped in order to better shed water and debris such as leaves or the like. Plastic panels 22' and 24' and there associated flanges 26' and 28' are similarly downwardly outwardly sloped at an angle θ. Preferably, θ is between is between 20° and 50° degrees and most preferably, between 25° and 45°.

Figure 3:
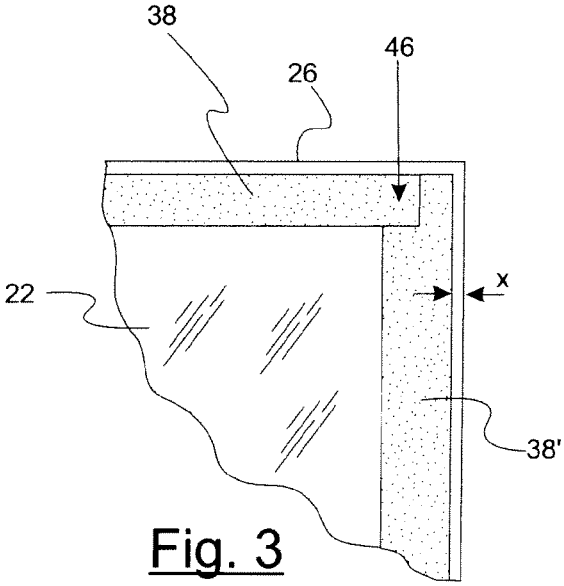
FIG. 3 is a top plan view of the two-sided elastic tape seal corner joint.

FIG. 3 illustrates a corner joint 46 formed between elastic tape member 38 and 38'. Corner joint 46 is a simple step configuration which is cut into two overlapping pieces of foam tape with the excess material removed. The joint gap is relatively small and does not form a straight line path between the enclosed region 36 and the outside environment.

Figure 4:
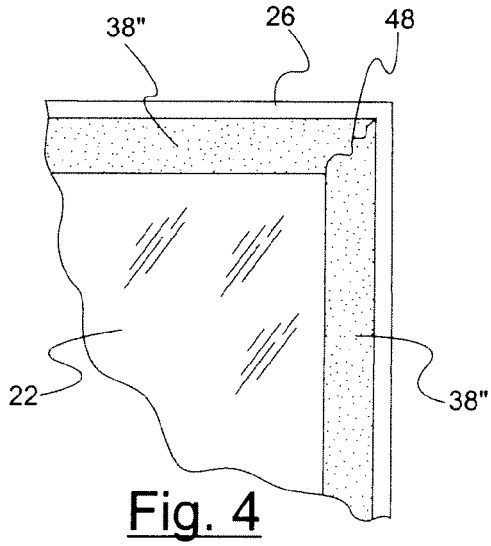
FIG. 4 is an alternative two-sided elastic tape seal corner joint.

FIG. 4 illustrates an alternative corner joint construction of a zig zag design. This type of joint can be made utilizing shears with a zig zag cut pattern. Again, the tape strips are overlapped and the zig zag cut pattern formed with shears. The excess ends are removed and the tape placed with the zig zag interconnecting lobes meeting in a relatively tight manner. Once the elastic tape is applied to one of the two plastic panels, the other panel is aligned and joined in a stacked relation forming a plastic panel subassembly.

Plastic panels 22 and 24 are preferably formed of acrylic having a nominal thickness of 0.002 to 0.50 inches and more preferably, about 0.10 to 0.25 inches. Of course, other at least semi-transparent visible light plastic materials can be used. The outer panel 22 needs to be of sufficient thickness to withstand the stresses placed upon it by building structural requirements and environmental damage causes like hail. The inner panel 24 may be a much thinner layer than the outer layer. To achieve a white translucent appearance, the plastic use can be at least partially filled with a coloring agent such as titanium dioxide. Alternatively, other clear materials such as polycarbonate or a multiple layer plastic panel can be utilized depending upon the strength, light transmission and UV degradation properties desired.

The elongated two-sided elastic tape seal 38 is preferably formed of a close cell foam having an adhesive layer on both the upper and lower surface. The close cell foam layer is preferably 0.25 to 1.5 inches wide depending upon the size of the skylight and more preferably, 0.375 to 0.75 inches in width. The thickness of the close cell foam tape in the uncompressed state is 0.03 to 0.40 inches and more preferably, 0.05 to 0.2 inches. Preferably, the close cell foam layer is formed of a polyurethane material or a polypropylene material, however, other foam compositions can be used. Tapes of this general type are used in a variety of construction applications and are commonly referred to as mounting tape.

Preferably, the elastic two-sided tape is inwardly inset from the outer most edge of the peripheral flange by 0.05 to 0.625 inches depending upon the size of the skylight, as illustrated by dimension X in FIG. 3. By insetting the tape slightly, the mold peripheral frame 40 can more securely entrap the peripheral flanges 26 and 28. Most preferably, the peripheral flanges are inset at 0.10 to 0.375 inches.

After the plastic panels are joined into a subassembly, the subassembly is then inserted into a mold and peripheral frame 40 is molded in situ about the peripheral flanges 26 and 28.

Once the plastic panels subassembly is positioned in the mold, the mold is closed and a moldable polymeric material is introduced into the mold cavity. The polymeric material encapsulates the overlapping outer peripheral flanges 26 and 28 and the elastic tape seal 38 prevents the moldable polymeric material from intruding into the central region 36. When the molding process is complete and the frame has sufficient structure to be handled, the skylight assembly is removed from the mold forming a substantially complete skylight. Frame 40 can be designed to mount on an existing skylight curb or frame 40 may be integrally formed with a curb 42 and flashing 44 as illustrated in FIG. 2*a*.

A moldable polymeric material utilized to form peripheral frame 40 can be any one of a number of polymeric materials.

Reaction injection moldable polymers (RIM) have been used to make skylights of the present invention quite satisfactorily. The preferred RIM material is a polyurethane described in co-pending patent application Ser. No. 11/057,891, which is commonly owned by the applicant and is incorporated by reference herein. The selected RIM material should good UV characteristic is preferably withstanding up to 20 years of use on a direct sunlight in roof top application without having a performance failure.

Alternatively, the peripheral frame 40 can be made using other moldable polymeric materials such as thermoplastics or filled thermoplastics, such as polyolefins, polyvinyl chloride, thermoplastic vulcanizates, liquid silicone rubber, fiber-reinforced plastics, thermoplastic elastomers, and engineering resins Thermoplastic material should be selected having a relatively low melting temperature so that the hot injected thermoplastic material does not damage the peripheral flange of the transparent plastic panels. Suitable thermoplastic materials are believed to be polyolefins, polyoxymethylene or poly butyl terephthalate and a suitable filled thermoplastic material is believed to be 20% glass filled polyoxylmethylene. Depending upon the material to be selected, it may be necessary to provide an adhesion layer painted on the peripheral flange of the plastic panels to better facilitate a bond between the material of the transparent plastic panels and the peripheral frame. Various suitable frame designs and materials are disclosed in co-pending commonly owned U.S. patent application filed Feb. 6, 2007, Ser. No. 11/671,726, incorporated by reference herein.

Figure 5:
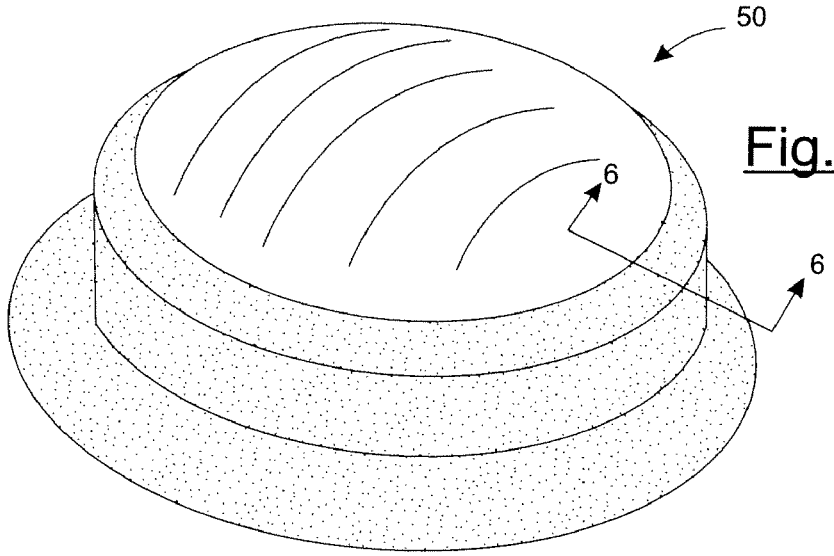
FIG. 5 is a perspective view of a circular skylight embodiment of the present invention.
Figure 6:
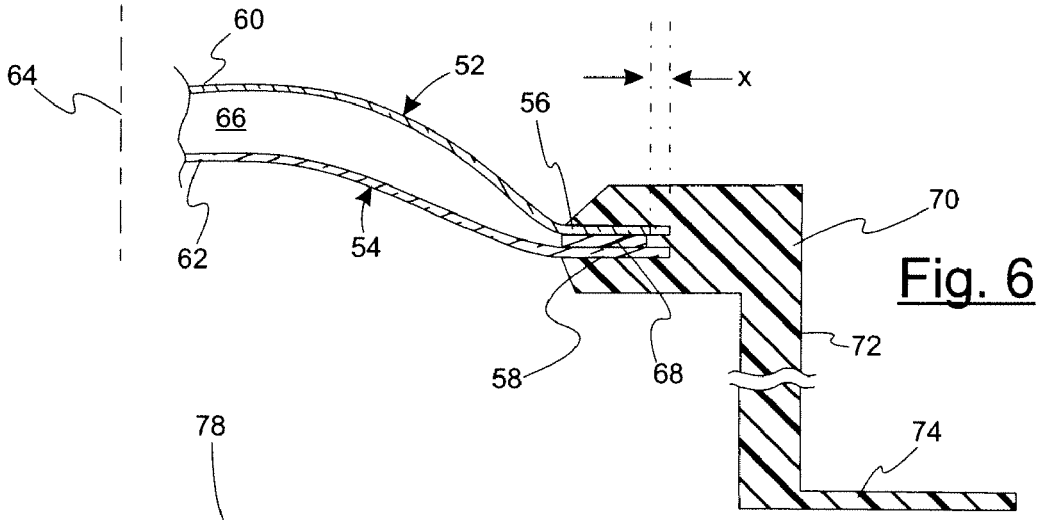
FIG. 6 is a cross-sectional view taken along line 6-6 of FIG. 5.
Figure 8:
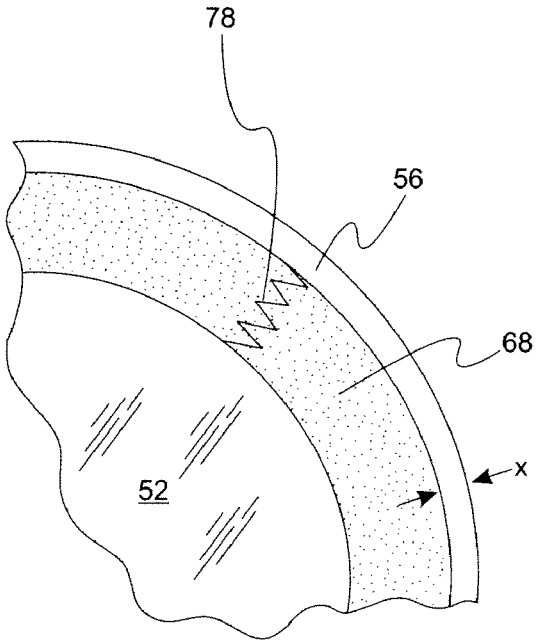
FIG. 8 is an alternative joint embodiment for the two-sided elastic tape strip.
Figure 7:
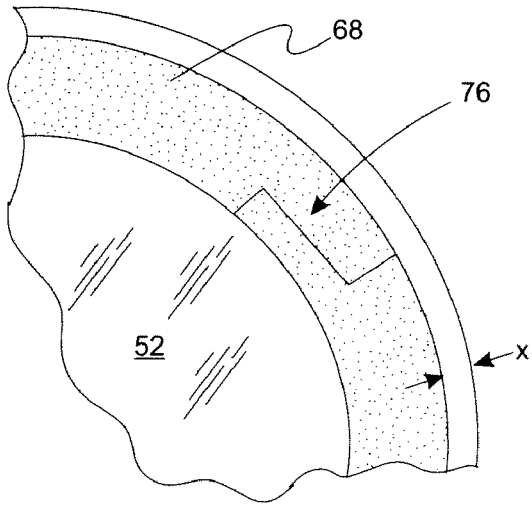
FIG. 7 is a top plan view illustrating a joint formed in the two-sided elastic tape strip.

FIG. 5 illustrates a circular skylight 50 made in accordance with the present invention. Circular skylight 50 is shown in cross-section in FIG. 6. Circular skylight 50 has a pair of transparent plastic panels 52 and 54, each having a peripheral flange 56 and 58. The plastic panels 52 and 54 have a transparent central region 60 and 62 extending symmetrically about central axis 64 and defining an enclosed space 66 there between. Peripheral flanges 56 and 58 are bonded together by elongated two-sided elastic tape seal 68. In FIG. 7, the elastic tape seal 68 is formed in a circle and the two ends are joined in a step joint as illustrate. FIG. 8 is a similar construction utilizing a zig zag joint. The circular skylight 50 can have a simple ring peripheral frame 70 or preferably, have an integrally formed ring 70, curb 72 and flashing member 74 as illustrated in FIG. 5 and FIG. 6.

Figure 9:
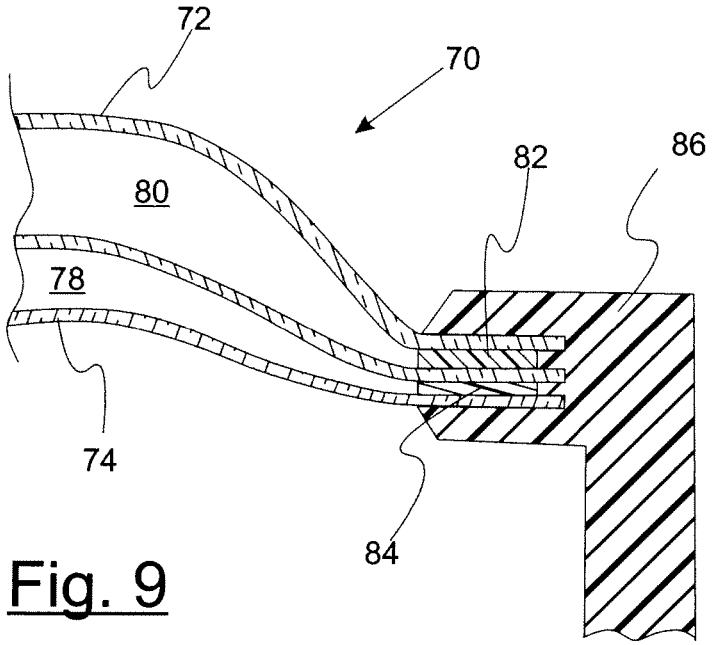
FIG. 9 is a cross-sectional embodiment of a skylight having a triple layer plastic panel assembly.
Figure 10:
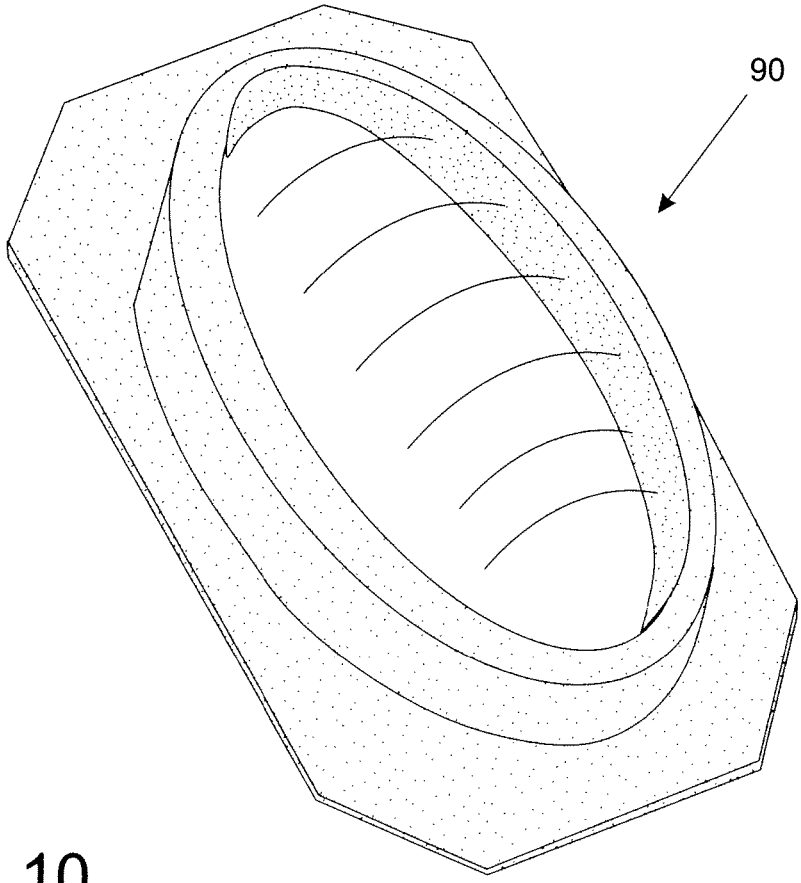
FIG. 10 is a perspective illustration of an elliptical skylight embodiment of the present invention.

An alternative plastic panel structure is shown in FIG. 9 having three layers. Skylight 70 has an outer transparent plastic panel 72, inner panel 74 and an intermediate panel 76, all generally domed, having slightly different curvatures so as to define enclosed regions 78 and 80 there between. In this triple pane embodiment, two elongate two-sided elastic tape seals 82 and 84 are provided between the outer layer and central layer 72 and 76 and between the central layer 76 and the inner layer 74, as illustrated. The triple layer plastic panel construction can be utilized in both the rectangular skylight as shown in FIG. 1, the circular skylight as shown in FIG. 5, or an elliptical skylight, as shown in FIG. 10. A molded polymeric frame 86 is formed about the outer peripheral flanges of the stacked plastic panels in the same manner as described with reference to the previous embodiments.

Figure 11:
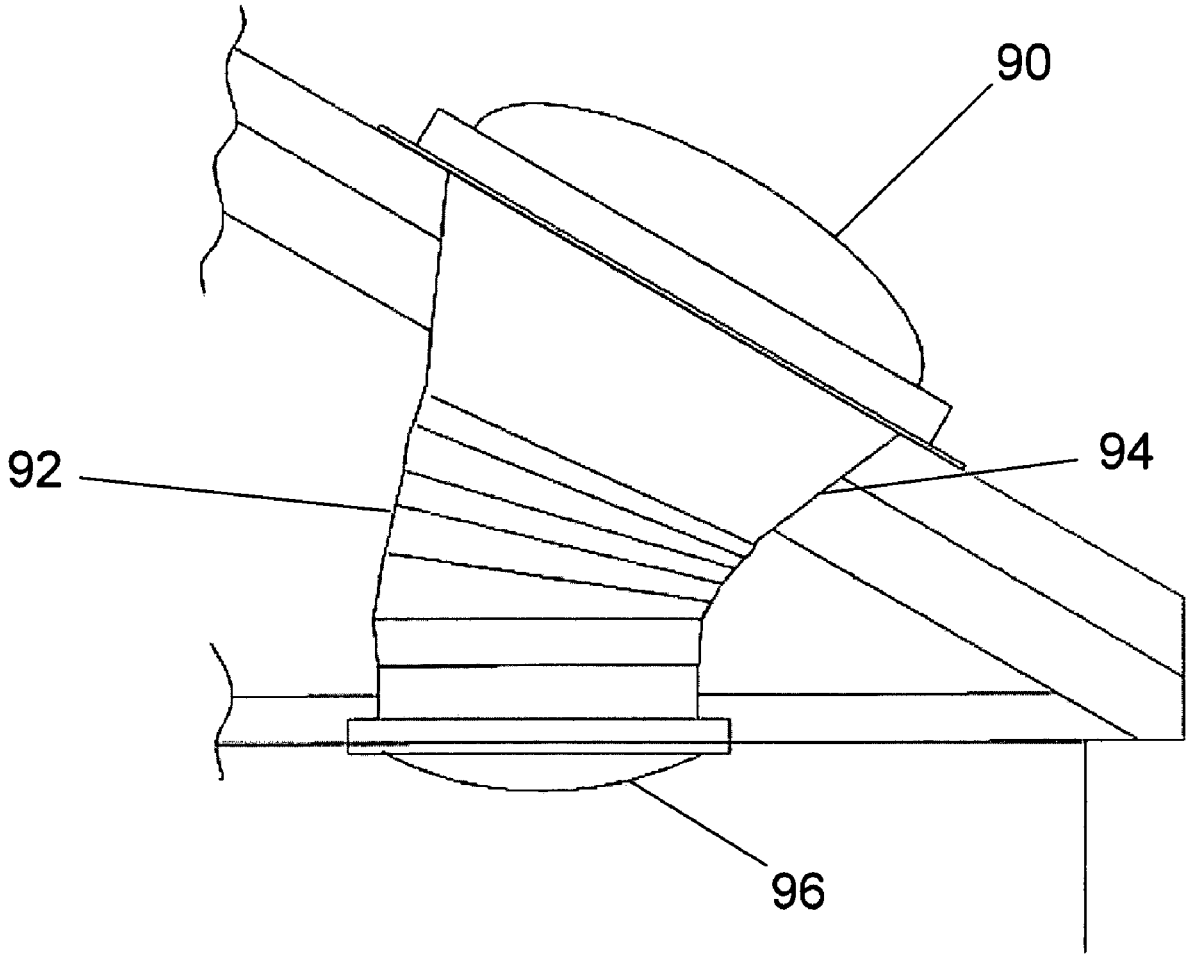
FIG. 11 is a side elevational view illustrating the skylight of FIG. 10 utilized as part of a tubular skylight assembly installed in a building.

FIG. 10 illustrates an elliptical shape skylight assembly 90 which is otherwise similar to circular skylight 50 of FIG. 5. Skylights can be installed in a building rooftop to provide direct light access into the building interior or as illustrated in FIG. 11, connected to a light tube 92 by a reflective transition member 94 to carry light from the building exterior to a light diffusor 96 located in the building ceiling in a conventional manner. The present invention is particularly well suited for making skylights of a variety of peripheral shapes inexpensively and with excellent long term durability and structural integrity of the joint between the transparent plastic panels and the frame member. Forming the frame in situ about the peripheral flanges of the plastic panels eliminates all of the frame joints typically present in fabricated frames of the prior art.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A skylight assembly comprising:

a pair of plastic panels, one of the pair of panels being an outer panel having an external surface exposed to the environment, each panel having a substantially similarly sized outer peripheral flange and a central region which is at least semi-transparent to visible light, the pair of plastic panels when aligned in stacked relation with the outer peripheral flanges generally overlying one another, define an enclosed region bounded by the spaced apart central regions of the pair of plastic panels;

an elongate two-sided elastic tape seal interposed between and bonding the outer peripheral flanges of the pair of plastic panels to form a sealed enclosed region which is filled with gas; and a peripheral structural frame formed in situ of a moldable polymeric material about the pair of plastic panels, the frame having an exterior flange and an interior flange entrapping the peripheral flanges of the plastic panels therebetween, the exterior flange having a top surface exposed to the environment and forming a leak tight structural joint with the outer panel;

wherein the two-sided elastic tape seal provides a fluid tight seal when the peripheral frame is molded preventing intrusion of the moldable polymeric material into the enclosed region.

2. The skylight assembly of claim 1 wherein the two-sided elastic tape seal further comprises a closed cell foam tape layer having an upper and lower surface coated with adhesive.

3. The skylight assembly of claim 2 wherein the closed cell foam tape layer has a width of 0.375 to 0.75 inches.

4. The skylight assembly of claim 2 wherein the closed cell foam tape layer has a nominal uncompressed thickness of 0.03 to 0.40 inches.

5. The skylight assembly of claim 2 wherein the closed cell foam tape layer has a nominal uncompressed thickness of 0.05 to 0.20 inches.

6. The skylight assembly of claim 2 wherein the closed cell foam layer is formed of polypropylene.

7. The skylight assembly of claim 2 wherein the closed cell foam tape layer has a width of 0.25 to 1.5 inches.

8. The skylight assembly of claim 1 wherein the two-sided elastic tape is inwardly inset from the outer most edge of the peripheral flange by 0.05 to 0.625 inches.

9. The skylight assembly of claim 1 wherein the plastic panels are formed of acrylic.

10. The skylight assembly of claim 1 wherein the plastic panels are formed of polycarbonate.

11. The skylight assembly of claim 1 wherein the peripheral frame is formed of a reaction injection molding material.

12. The skylight assembly of claim 1 wherein the peripheral frame is formed of a thermoplastic material.

13. The skylight assembly of claim 12 wherein the thermoplastic material is filled with reinforcing fibers.

14. The skylight assembly of claim 1 wherein the skylight assembly has a generally central axis with the peripheral frame lying in a plane generally normal to the axis.

15. The skylight assembly of claim 14 wherein the outer peripheral flanges of the pair of plastic panels lie in a plane perpendicular to the central axis.

16. The skylight assembly of claim 1 wherein the pair of plastic panels comprises an inner panel and the outer panel when aligned in stacked relation, the inner panel having a thickness that is smaller than a thickness of the outer panel.

17. The skylight assembly of claim 1 wherein the frame is integrally formed with a curb and a flashing portion, forming a unitary piece.

18. A skylight assembly comprising:

a pair of plastic panels each having a similarly sized outer peripheral flange and a central region which is at least semi-transparent to visible light, the pair of plastic panels when aligned in stacked relation with the outer peripheral flanges generally overlying one another, define an enclosed region bounded by the spaced apart central regions of the pair of plastic panels;

a peripheral structural frame formed in situ of a moldable polymeric material about the pair of plastic panels, the frame having an exterior flange and an interior flange entrapping the peripheral flanges of the plastic panels therebetween, the exterior flange having a top surface exposed to the environment and forming a leak tight structural joint with the outer panel; and an elongate two-sided elastic tape seal interposed between and bonding the outer peripheral flanges of the pair of plastic panels to form a sealed enclosed region which is filled with gas, the tape having at least two ends which abut and sealingly join one another in a non overlapping manner forming a joint which has a leak path which is substantially longer than the width of the two-sided elastic tape to restrict leakage of the frame material during the forming process.

19. The skylight assembly of claim 18 wherein the two-sided elastic tape is inwardly inset from the outer most edge of the peripheral flange by 0.10 to 0.375 inches.

20. The skylight assembly of claim 18 wherein the peripheral frame is generally rectangular in shape.

21. The skylight assembly of claim 18 wherein the peripheral frame is elongated and generally ellipsoidal in shape.

22. The skylight assembly of claim 18 wherein the joint connecting the ends of the two-sided elastic tape is generally zigzag in shape.

23. A skylight assembly comprising:

a pair of plastic panels each having a similarly sized outer peripheral flange and a central region which is at least semi-transparent to visible light, the pair of plastic panels when aligned in stacked relation with the outer peripheral flanges generally overlying one another, define an enclosed region bounded by the spaced apart central regions of the pair of plastic panels;

an elongate two-sided elastic tape seal interposed between and bonding the outer peripheral flanges of the pair of plastic panels to form a sealed enclosed region which is filled with gas; and a peripheral structural frame formed in situ of a moldable polymeric material about the pair of plastic panels, the frame having an exterior flange and an interior flange entrapping the peripheral flanges of the plastic panels therebetween, the exterior flange having a top surface exposed to the environment and forming a leak tight structural joint with the outer panel thereof and forming a leak tight structural joint therewith; and wherein the two-sided elastic tape provides a seal as the peripheral frame is molded preventing intrusion of the moldable polymeric material into the enclosed region and the outer peripheral flanges of the plastic panels are outwardly inclined downwardly relative to a generally central axis of the skylight assembly and a plane normal thereto and the central region of the plastic panels bows upwardly from the peripheral frame.

24. The skylight assembly of claim 23 wherein the outer peripheral flanges of the plastic panels are outwardly inclined downwardly at an angle between 20° and 50° degrees.

* * * * *